US008541932B2

(12) United States Patent
Horng

(10) Patent No.: US 8,541,932 B2
(45) Date of Patent: Sep. 24, 2013

(54) LAMP WITH HEAT DISSIPATER

(75) Inventor: Alex Horng, Kaohsiung (TW)

(73) Assignee: Sunonwealth Electric Machine Industry Co., Ltd, Kaohsiung (TW)

( * ) Notice: Subject to any disclaimer, the term of this patent is extended or adjusted under 35 U.S.C. 154(b) by 15 days.

(21) Appl. No.: 12/910,434

(22) Filed: Oct. 22, 2010

(65) Prior Publication Data

US 2012/0062095 A1 Mar. 15, 2012

(30) Foreign Application Priority Data

Sep. 15, 2010 (TW) ..... 99131287 A

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl.
USPC ..... 313/46; 313/35; 313/36; 362/294

(58) Field of Classification Search
USPC ..... 313/35, 36, 46; 362/294
See application file for complete search history.

(56) References Cited

U.S. PATENT DOCUMENTS

| | | | | |
|---|---|---|---|---|
| 3,609,335 | A * | 9/1971 | Kelly | 362/33 |
| 6,095,671 | A * | 8/2000 | Hutain | 362/373 |
| 7,021,793 | B2 * | 4/2006 | Biasoli et al. | 362/267 |
| 7,144,140 | B2 * | 12/2006 | Sun et al. | 362/373 |
| 7,458,706 | B1 | 12/2008 | Liu et al. | |
| 7,575,346 | B1 * | 8/2009 | Horng et al. | 362/373 |
| 7,637,635 | B2 | 12/2009 | Xiao et al. | |
| 7,648,258 | B2 | 1/2010 | Shuai et al. | |
| 7,677,770 | B2 * | 3/2010 | Mazzochette | 362/364 |
| 7,841,752 | B2 * | 11/2010 | Lee | 362/373 |
| 7,871,184 | B2 * | 1/2011 | Peng | 362/294 |
| 7,914,182 | B2 * | 3/2011 | Mrakovich et al. | 362/373 |
| 7,950,826 | B2 * | 5/2011 | Shin | 362/249.02 |
| 8,066,410 | B2 * | 11/2011 | Booth et al. | 362/294 |
| 8,143,769 | B2 * | 3/2012 | Li | 313/46 |
| 2006/0193139 | A1 * | 8/2006 | Sun et al. | 362/373 |
| 2008/0049399 | A1 * | 2/2008 | Lu et al. | 361/714 |
| 2008/0165535 | A1 * | 7/2008 | Mazzochette | 362/294 |

(Continued)

FOREIGN PATENT DOCUMENTS

| | | |
|---|---|---|
| CN | 101672432 A | 3/2010 |
| TW | M330426 | 4/2008 |
| TW | M346745 | 12/2008 |
| TW | I327633 | 7/2010 |

*Primary Examiner* — Nimeshkumar Patel
*Assistant Examiner* — Thomas A Hollweg
(74) *Attorney, Agent, or Firm* — Muncy, Geissler, Olds & Lowe, PLLC

(57) ABSTRACT

A lamp includes a heat dissipater having a base and an engaging member. The base includes a first air guiding portion and a fixing portion. The engaging member is mounted to an outer periphery of the base. A second air guiding portion is formed between the engaging member and the base. A lighting element is mounted to the base of the heat dissipater. A housing is engaged with the engaging member of the heat dissipater. The housing and the heat dissipater together define a compartment in communication with the first and second air guiding portions. A cooling fan is mounted to the fixing portion of the base. A circuit board is mounted in the compartment and electrically connected to the lighting element and the cooling fan. The circuit board is electrically connected to an electrically conductive member having an end extending out from the housing.

8 Claims, 9 Drawing Sheets

(56) References Cited

U.S. PATENT DOCUMENTS

2008/0212333 A1* 9/2008 Chen ..... 362/373
2009/0109625 A1* 4/2009 Booth et al. ..... 361/702
2009/0200908 A1* 8/2009 Mart et al. ..... 313/11
2009/0237932 A1* 9/2009 Lee ..... 362/249.02
2010/0020537 A1* 1/2010 He et al. ..... 362/234
2010/0027270 A1* 2/2010 Huang et al. ..... 362/310
2011/0037368 A1* 2/2011 Huang ..... 313/46
2011/0110095 A1* 5/2011 Li et al. ..... 362/294

* cited by examiner

LAMP WITH HEAT DISSIPATER

BACKGROUND OF THE INVENTION

1. Field of the Invention

The present invention relates to a lamp and, more particularly, to a lamp including a hollow casing formed by a heat dissipater.

2. Description of the Related Art

FIG. 1 shows a conventional lamp 8 including a cooling body 81 with a plurality of fins 811 on an outer periphery thereof. A lighting element 82 is mounted to an end of the cooling body 81. An electrically conductive member 83 is mounted to the other end of the cooling body 81 and electrically connected to the lighting element 82. Through control by a control unit such as a circuit board, the lighting element 82 emits light beams after the electrically conductive member 83 is supplied with electricity. The cooling body 81 assists in dissipation of heat generated during operation of the lighting element 82 and the electrically conductive member 83.

However, the cooling body 81 must be large enough to receive the lighting element 82 and the electrically conductive member 83 for cooling purposes, leading to a bulky cooling body 81 and causing inconvenience in usage. Furthermore, the lamp 8 does not include ventilation holes and cooling fans and, thus, can not provide excellent cooling effect. The overall cooling effect of the lamp 8 is thus not satisfactory, shortening the service life of the lighting element 82.

To mitigate the disadvantages of the lamp 8, FIG. 2 shows another conventional lamp 9 including a first housing 91, a second housing 92, a circuit board 93, a cooling module 94, and a lighting element 95. The first housing 91 has a plurality of air inlets 911. The second housing 92 has a plurality of air outlets 921. The circuit board 93, the cooling module 94, and the lighting element 95 are mounted in a hollow casing formed by the first and second housing 91 and 92. The cooling module 94 is comprised of a cooling fan 941 and a heat dissipater 942. The circuit board 93 is electrically connected to the cooling fan 941 and the lighting element 95. The lighting element 95 is connected to the heat dissipater 942.

When the lighting element 95 is supplied with electricity and generates heat, the circuit board 93 drives the cooling fan 941 to rotate. Ambient air is driven in via the air inlets 911 and cooperates with the heat dissipater 942 to dissipate the heat generated by the lighting element 95. Furthermore, the heat is carried away by the hot air that is driven out by the cooling fan 941 via the air outlets 921, obtaining the predetermined cooling effect and prolonging the service life of the lighting element 95.

However, the lamp 9 still has several disadvantages. Firstly, the hollow casing of the lamp 9 is comprised of the first and second housings 91 and 92 for receiving the circuit board 93, the cooling module 94, and the lighting element 95. Thus, the lamp 9 has a complicated structure, and the assembly is inconvenient. Furthermore, the first and second housings 91 and 92 must be processed to form the air inlets 911 and the air outlets 921, leading to inconvenience in manufacturing and high manufacturing costs. Secondly, the air inlets 911 and the air outlets 921 are arranged mainly to introduce ambient air to dissipate the lighting element 95. The cooling effect is poor at the circuit board 93.

Thus, a need exists for a lamp with improved cooling effect.

SUMMARY OF THE INVENTION

The primary objective of the present invention is to provide a lamp with simplified structure.

Another objective of the present invention is to provide a lamp that can be assembled easily.

A further objective of the present invention is to provide a lamp that provides excellent cooling effect.

The present invention fulfills the above objectives by providing, in a first aspect, a lamp including a heat dissipater having a base and an engaging member. The base includes a first air guiding portion and a fixing portion. The engaging member is mounted to an outer periphery of the base. A second air guiding portion is formed between the engaging member and the base. A lighting element is mounted to the base of the heat dissipater. A housing is engaged with the engaging member of the heat dissipater. The housing and the heat dissipater together define a compartment in communication with the first and second air guiding portions. A cooling fan is mounted to the fixing portion of the base. A circuit board is mounted in the compartment and electrically connected to the lighting element and the cooling fan. The circuit board is electrically connected to an electrically conductive member having an end extending out from the housing.

According to a second aspect, a lamp includes a heat dissipater having a base and an engaging member. The base includes a first air guiding portion and a fixing portion. The engaging member is mounted to an outer periphery of the base. A lighting element is mounted to the base of the heat dissipater. A housing is engaged with the engaging member of the heat dissipater. The housing includes a second air guiding portion. The housing and the heat dissipater together define a compartment in communication with the first and second air guiding portions. A cooling fan is mounted to the fixing portion of the base. A circuit board is mounted in the compartment and electrically connected to the lighting element and the cooling fan. The circuit board is electrically connected to an electrically conductive member having an end extending out from the housing.

The present invention will become clearer in light of the following detailed description of its illustrative embodiments described in connection with the drawings.

BRIEF DESCRIPTION OF THE DRAWINGS

The illustrative embodiments may best be described by referring to the accompanying drawings where.

Figure 1:
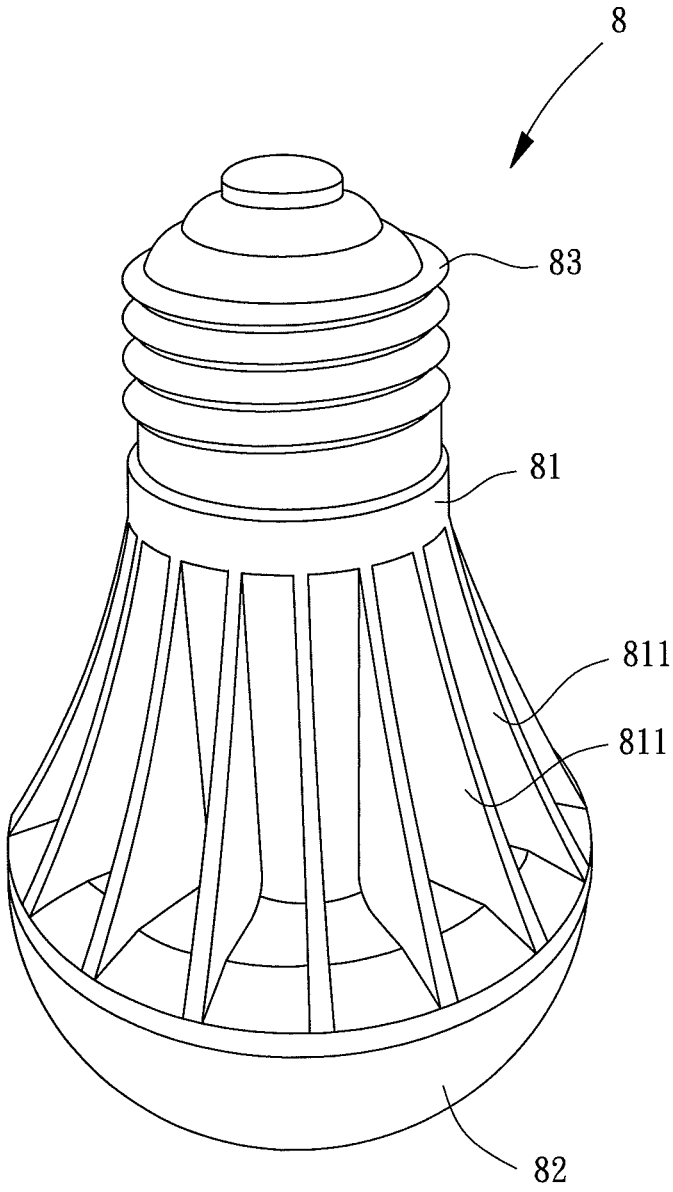
FIG. 1 PRIOR ART
FIG. 1 shows a perspective view of a conventional lamp.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions conforming to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "inner", "outer", "side", "end", "portion", "radial", "annular", and similar terms are used herein, it should be understood that these terms refer only to the structure shown in the drawings as it would appear to a person viewing the drawings and are utilized only to facilitate describing the invention.

DETAILED DESCRIPTION OF THE INVENTION

Figure 3:
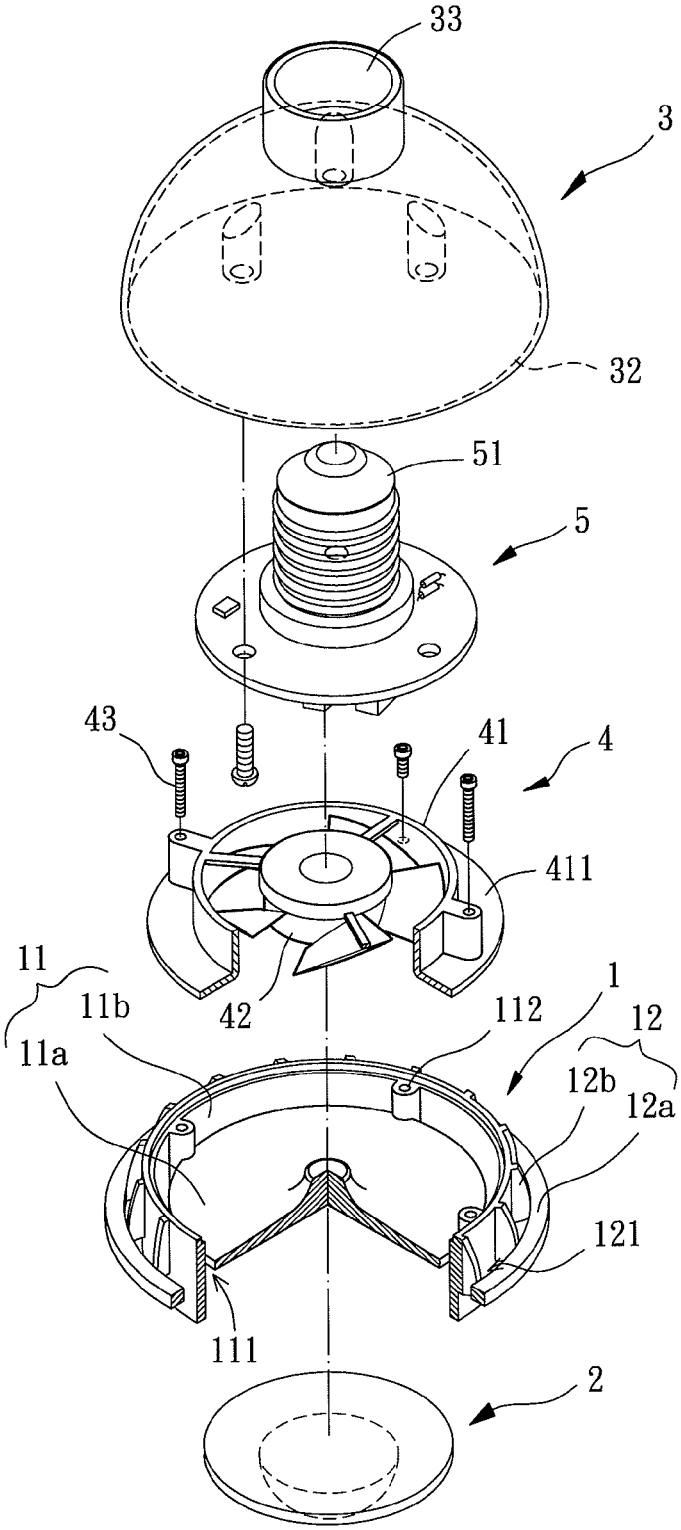
FIG. 3 shows an exploded, perspective view of a lamp of a first embodiment according to the preferred teachings of the present invention.
Figure 4:
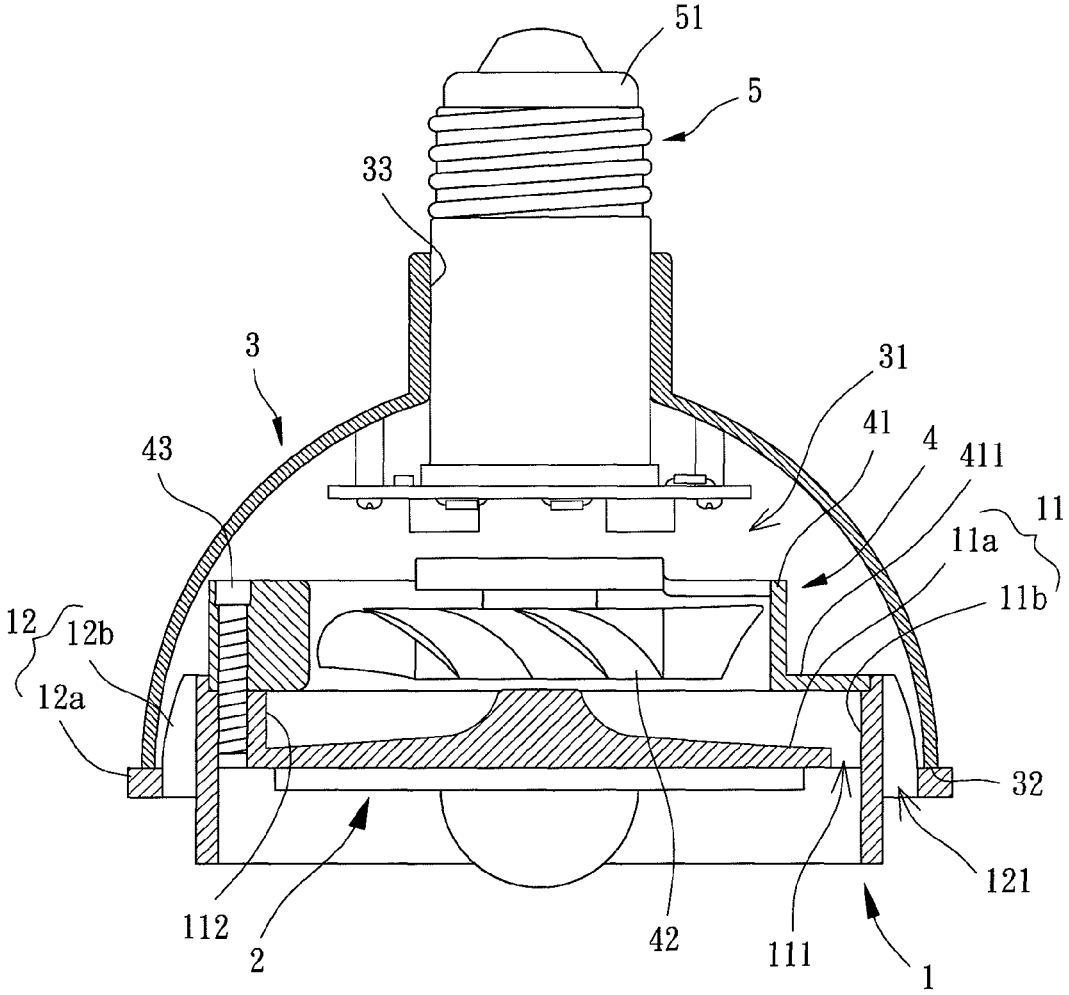
FIG. 4 shows a cross sectional view of the lamp of FIG. 3 after assembly.

A cooling fan of a first embodiment according to the preferred teachings of the present invention is shown in FIGS. 3 and 4 and generally includes a heat dissipater 1, a lighting element 2, a housing 3, a cooling fan 4, and a circuit board 5. The heat dissipater 1 is engaged with the lighting element 2. The housing 3 engages with the heat dissipater 1 to form a hollow casing for receiving the cooling fan 4 and the circuit board 5. The cooling fan 4 is engaged and cooperates with the heat dissipater 1 to provide cooling effect for the lighting element 2. The circuit board 5 is electrically connected to the cooling fan 4 for driving the cooling fan 4 to rotate.

The heat dissipater 1 includes a base 11 and an engaging member 12. The base 11 includes a first air guiding portion 111 and a fixing portion 112. The first air guiding portion 111 can be of any structure allowing passage of air into or out of the hollow casing. The first air guiding portion 111 can provide air inlet effect or air outlet effect according to the rotating direction of the cooling fan 4. The fixing portion 112 can be of any structure allowing engagement with the cooling fan 4. The engaging member 12 is mounted to an outer periphery of the base 11 with a second air guiding portion 121 formed between the engaging member 12 and the base 11. The second air guiding portion 121 can be of any structure allowing passage of air into or out of the hollow casing. The second air guiding portion 121 can provide air inlet effect or air outlet effect according to the rotating direction of the cooling fan 4.

Figure 5:
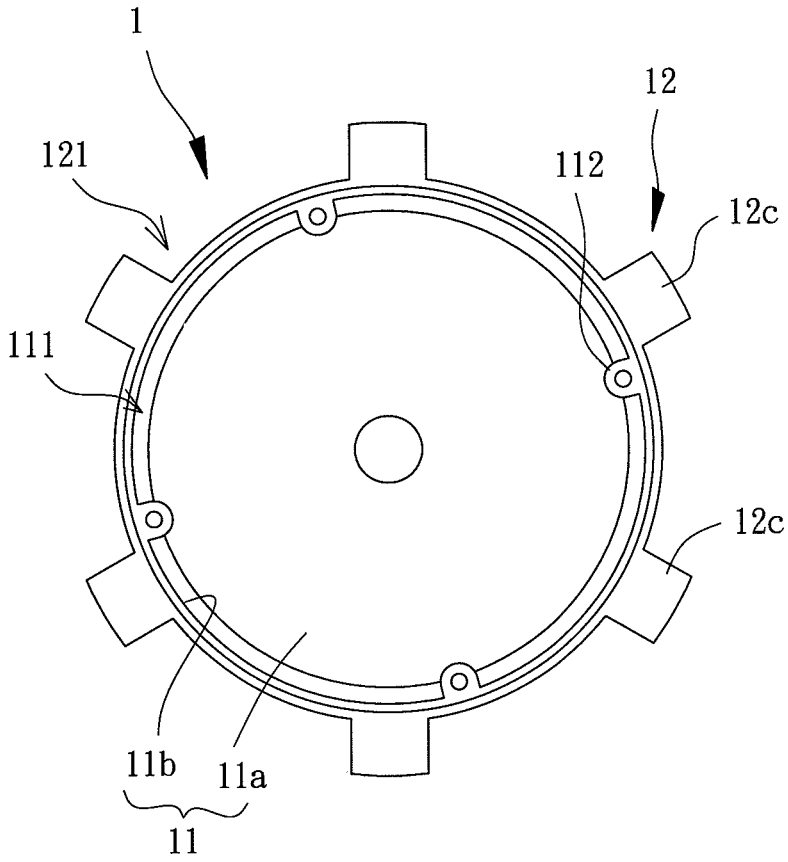
FIG. 5 shows a top view of a lamp of a modified embodiment according to the preferred teachings of the present invention.

In this embodiment, the base 11 includes a seat 11*a* and an annular wall 11*b* formed along an outer periphery of the seat 11*a*. The first air guiding portion 111 is in the form of at least one passageway formed between an adjoining area between the seat 11*a* and the annular wall 11*b*. The passageway of the first air guiding portion 111 serves as an air outlet. The fixing portion 112 includes a plurality of pegs formed on an inner periphery of the annular wall 11*b*. Furthermore, the engaging member 12 includes an engaging ring 12*a* connected to the annular wall 11*b* by a plurality of connecting ribs 12*b*. By such an arrangement, the second air guiding portion 121 is in the form of a plurality of passageways between the connecting ribs 12*b*. The passageways of the second air guiding portion 121 serve as air inlets. In an alternative embodiment shown in FIG. 5, the engaging member 12 includes a plurality of protrusions 12*c* formed on an outer periphery of the annular wall 11*b*, and the second air guiding portion 121 includes a plurality of passageways formed between the protrusions 12*c* and serving as air inlets.

The lighting element 2 is mounted to the base 11 of the heat dissipater 1. The lighting element 2 can be a light-emitting diode (LED), a bulb, or any other member that can emit light beams when supplied with electricity. In this embodiment, the lighting element 2 is mounted to a side of the seat 11*a* of the heat dissipater 1.

The housing 3 is engaged with the engaging member 12 of the heat dissipater 1. The hollow casing formed by housing 3 and the heat dissipater 1 includes a compartment 31 (FIG. 4) in communication with the first and second air guiding portions 111 and 121. In this embodiment, the housing 3 is a hollow semi-sphere and includes an opening 32 in an end thereof. A through-hole 33 is formed in the other end of the housing 3. An end edge of the housing 3 having the opening 32 is fixed to the engaging ring 12*a* by suitable provisions such as welding, bonding, locking, male/female coupling, etc.

The cooling fan 4 is mounted to the fixing portion 112 of the base 11 and aligned with the first air guiding portion 111. In this embodiment, the cooling fan 4 includes a fan housing 41 in which a fan wheel 42 is rotatably received. The fan housing 41 can be fixed by a plurality of fasteners 43 (such as screws or the like) to the fixing portion 112 (the pegs). Thus, the fan housing 41 is securely fixed to the base 11. Furthermore, the fan housing 41 can include a block portion 411 engaged with the base 11. The block portion 411 prevents reverse flow of air currents flowing through the first air guiding portion 111.

The circuit board 5 is mounted in the compartment 31 and electrically connected to the lighting element 2 and the cooling fan 4 for controlling the lighting element 2 and for driving the fan wheel 42 of the cooling fan 4 to rotate. The circuit board 5 also includes an electrically conductive member 51 that has an end exposed outside of the housing 3. In this embodiment, the end of the electrically conductive member 51 of the circuit board 5 extends out from the housing 3 via the through-hole 33 of the housing 3.

In use of the lamp according to the preferred teachings of the present invention, the lamp can be mounted to a lamp seat on a wall, ceiling, or desk. The lamp is electrically connected to an electricity service system via the electrically conductive member 51 such that the lighting element 2 can emit light beams when supplied with electricity. The electricity service system also provides power to the cooling fan 4 for operation. With the arrangement of the first and second air guiding portions 111 and 121 in communication with the compartment 31 receiving the circuit board 5, and by the engagement between the lighting element 2 and the heat dissipater 1, the first and second air guiding portions 111 and 121 cooperate with the cooling fan 4 to provide excellent cooling effect for the lighting element 2 and the circuit board 5 when the lighting element 2 and the circuit board 5 are supplied with electricity and generate heat.

Specifically, with reference to FIG. 4, when the circuit board 5 drives the fan wheel 42 of the cooling fan 4 to rotate, the fan wheel 42 drives air currents into the compartment 31 via the second air guiding portion 121 to dissipate the heat generated by the circuit board 5. Furthermore, the heat dissipater 1 transmits the heat generated by the lighting element 2 supplied with electricity, and the fan wheel 42 guides the air currents out via the first air guiding portion 111. The heat of the heat sources is thus transmitted to the outside, obtaining better cooling effect and prolonging the service life of the lighting element 2.

Figure 6:
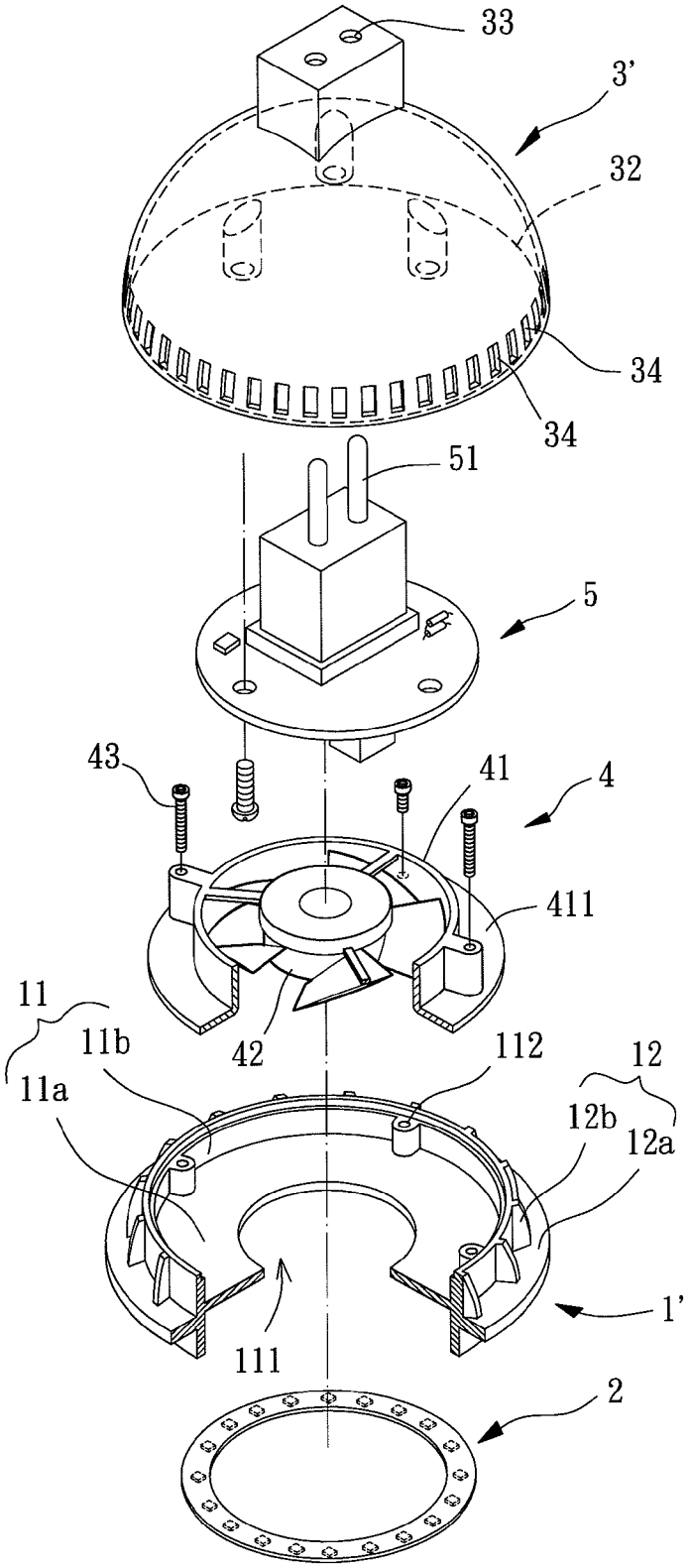
FIG. 6 shows an exploded, perspective view of a lamp of a second embodiment according to the preferred teachings of the present invention.
Figure 7:
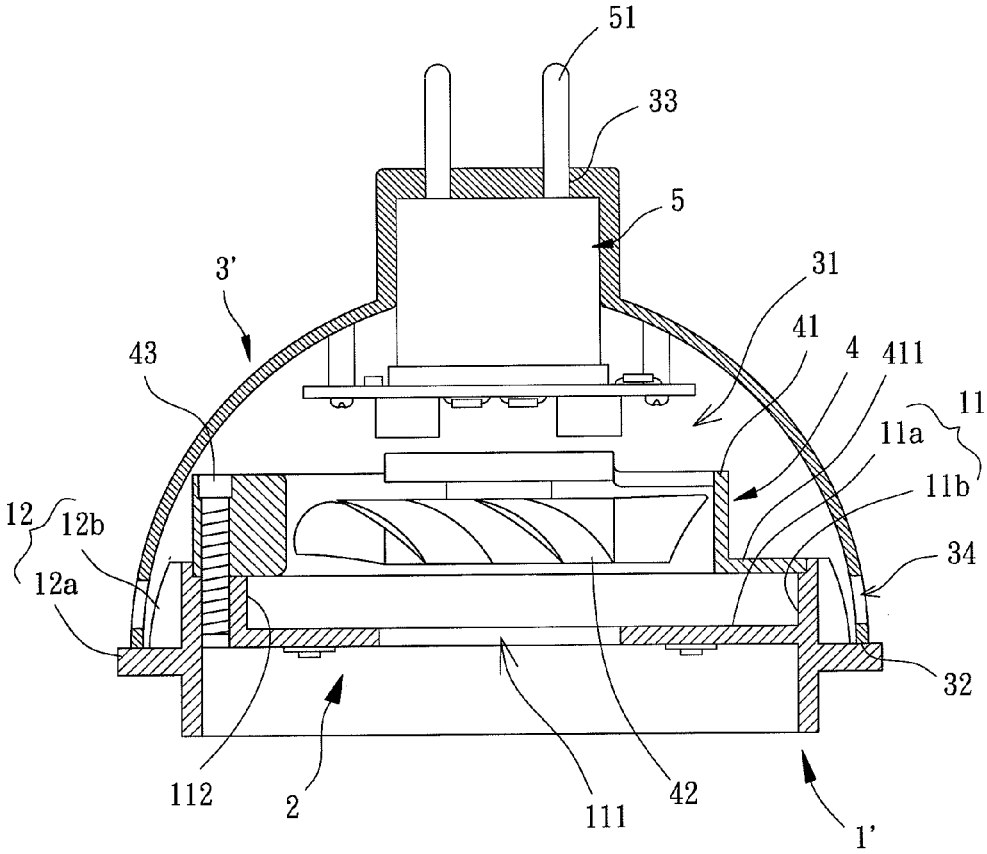
FIG. 7 shows a cross sectional view of the lamp of FIG. 6 after assembly.

FIGS. 6 and 7 show a lamp of a second embodiment according to the preferred teachings of the present invention. The lamp also includes a heat dissipater 1', a lighting element 2, a housing 3', a cooling fan 4, and a circuit board 5. The lighting element 2, the cooling fan 4 and the circuit board 5 in this embodiment are substantially the same as those in the first embodiment except for minor modification to the outlines, and are thus not described in details to avoid redundancy.

The main difference between the heat dissipater 1' of the second embodiment and the heat dissipater 1 of the first embodiment is that the first air guiding portion 111 of the heat dissipater 1' is in the form of at least one passageway formed in a central portion of the seat 11*a*, and that the heat dissipater 1' of the second embodiment does not include the second air guiding portion 121 of the first embodiment. Furthermore, the housing 3' of the second embodiment includes a second air guiding portion 34 in communication with the compartment 31. In the second embodiment, the second air guiding portion 34 includes a plurality of passageways extending through the housing 3' and serving as air inlets. With reference to FIG. 7, when the fan wheel 42 of the cooling fan 4 rotates, the fan wheel 42 drives air currents into the compartment 31 via the second air guiding portion 34 to transmit the heat generated by the circuit board 5 and the lighting element 2 to the outside via the first air guiding portion 111, obtaining better cooling effect and prolonging the service life of the lighting element 2.

Figure 8:
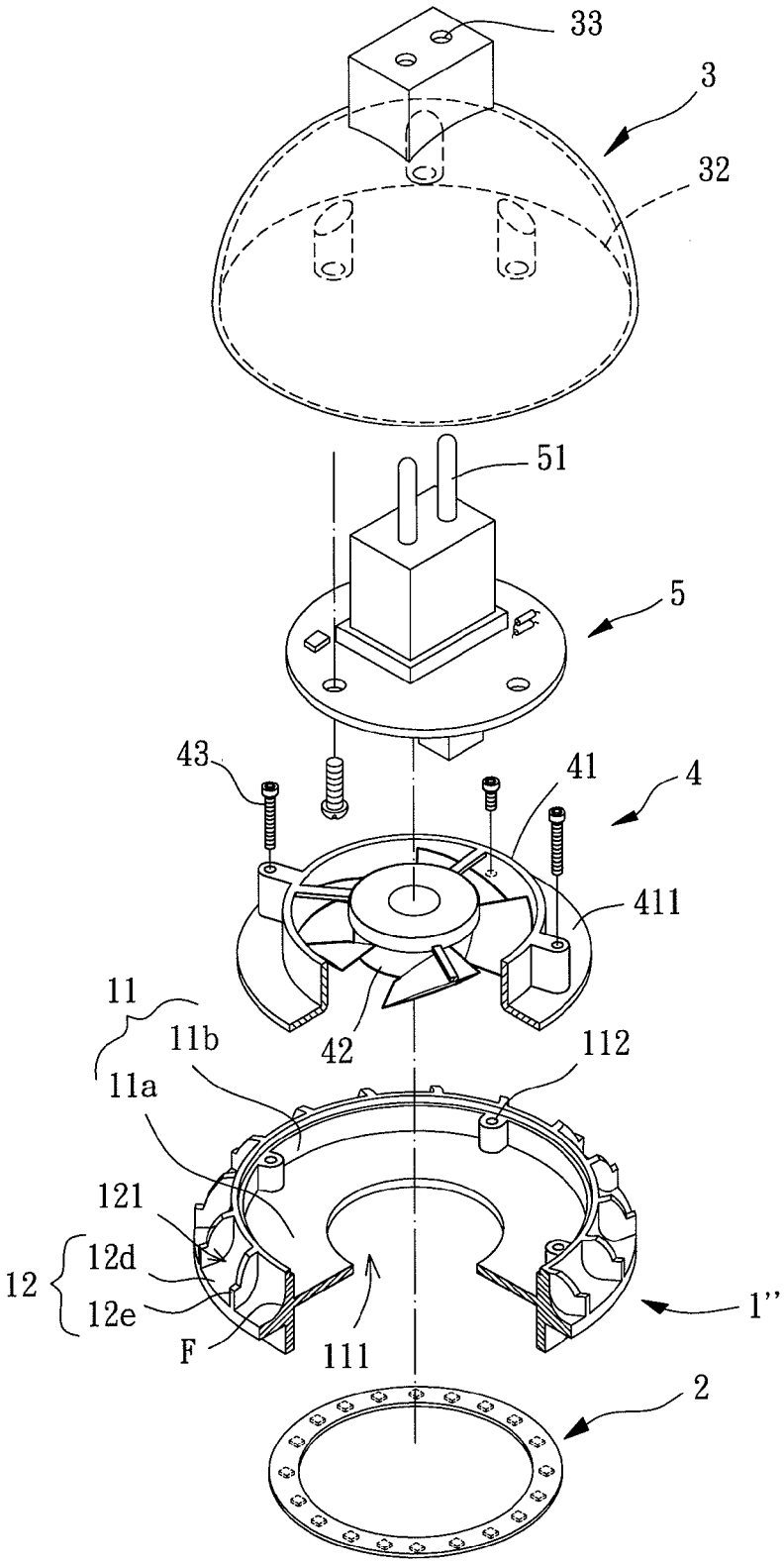
FIG. 8 shows an exploded, perspective view of a lamp of a third embodiment according to the preferred teachings of the present invention.
Figure 9:
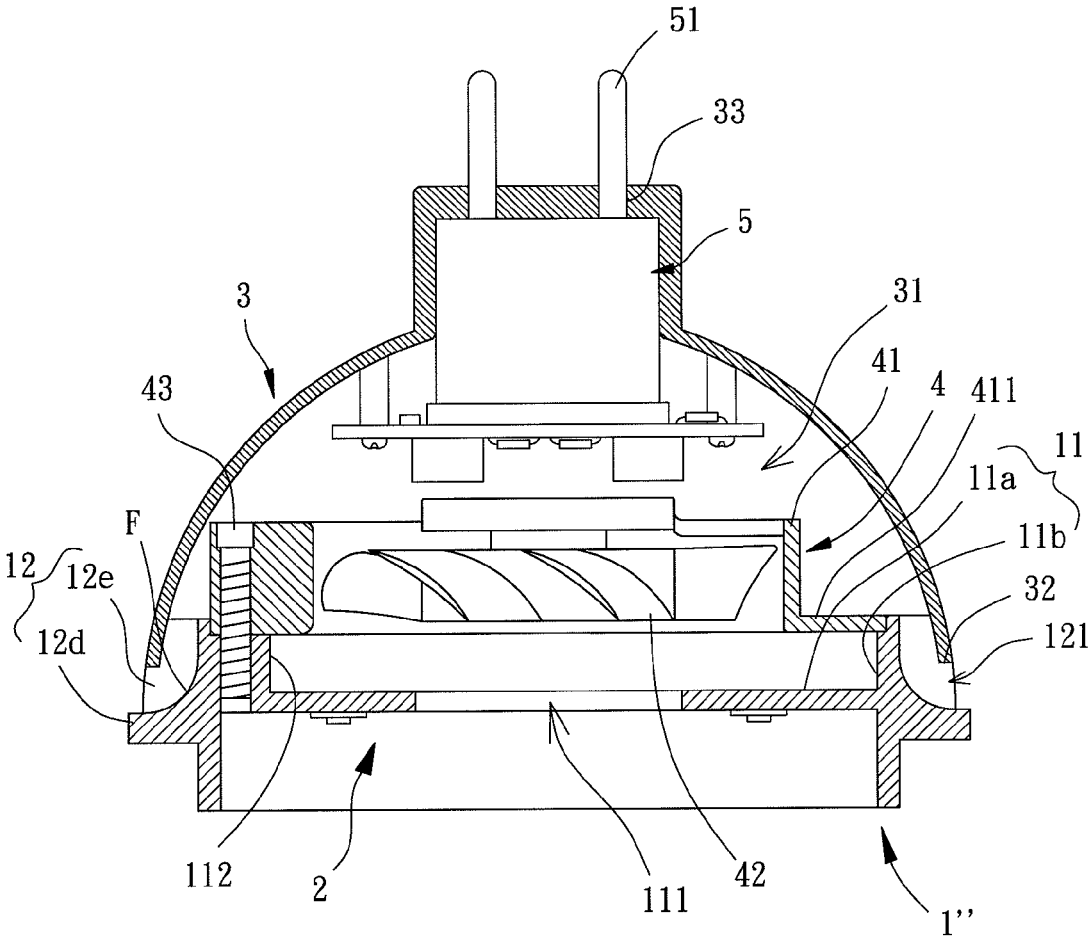
FIG. 9 shows a cross sectional view of the lamp of FIG. 8 after assembly.

FIGS. 8 and 9 show a lamp of a third embodiment according to the preferred teachings of the present invention. The lamp also includes a heat dissipater 1", a lighting element 2, a housing 3, a cooling fan 4, and a circuit board 5. The lighting element 2, the housing 3, the cooling fan 4, and the circuit board 5 in this embodiment are substantially the same as those in the first embodiment and are thus not described in details to avoid redundancy.

The main difference between the heat dissipater 1" of the third embodiment and the heat dissipater 1 of the first embodiment is that the first air guiding portion 111 of the heat dissipater 1" is in the form of at least one passageway formed in a central portion of the seat 11*a*. Furthermore, the engaging member 12 includes a flange 12*d*, and a plurality of support blocks 12*e* extends from an outer surface of the flange 12*d*. The end edge of the opening 32 of the housing 3 is fixed to the support blocks 12*e* of the engaging member 12. Thus, the second air guiding portion is in the form of a plurality of radial passageways formed between the support blocks 12*e* and serving as air inlets. With reference to FIG. 9, when the fan wheel 42 of the cooling fan 4 rotates, the fan wheel 42 drives air currents into the compartment 31 via the second air guiding portion 121 to transmit the heat generated by the circuit board 5 and the lighting element 2 to the outside via the first air guiding portion 111, obtaining better cooling effect and prolonging the service life of the lighting element 2.

An arcuate guide face F can be formed in an adjoining area between the flange 12*d* of the engaging member 12 and the annular wall 11*b* of the base 11 to provide an air guiding effect.

Figure 2:
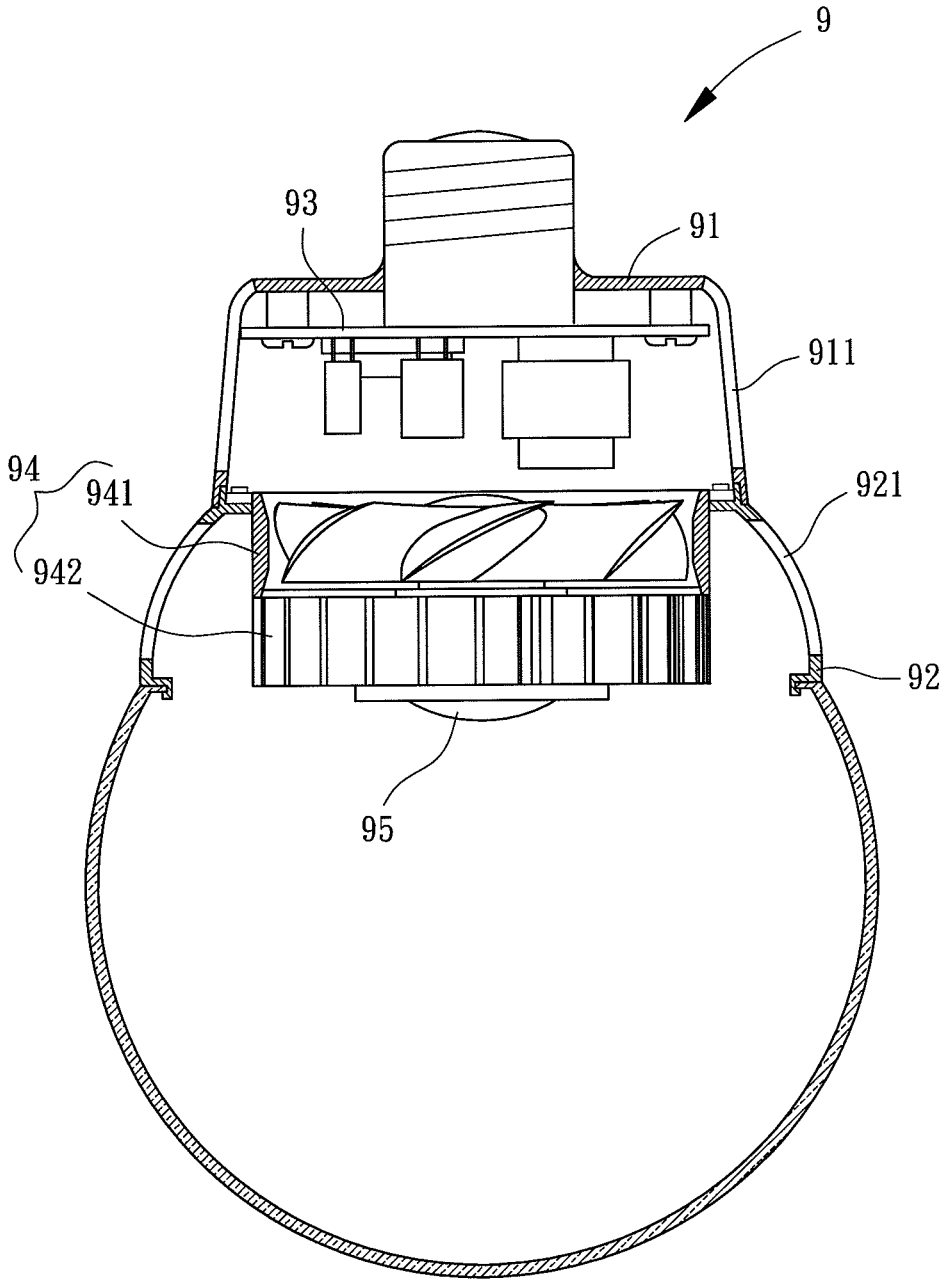
FIG. 2 PRIOR ART
FIG. 2 shows a cross sectional view of another conventional lamp.

In view of the foregoing, the lamp according to the preferred teachings of the present invention is simple in structure. Specifically, the compartment 31 receiving the lighting element 2, the cooling fan 4, and the circuit board 5 is defined by the heat dissipater 1, 1', 1" and the housing 3, 3' through provision of the engaging member 12 of the heat dissipater 1, 1', 1". Compared to the hollow casing comprised of the first and second housings 91 and 92 of the lamp 9 shown in FIG. 2, one of the first and second housings 91 and 92 is replaced with the heat dissipater 1, 1', 1" in the lamp according to the preferred teachings of the present invention. Thus, the whole structure is simplified and allows convenient manufacturing. Furthermore, the assembly of the lamp according to the preferred teachings of the present invention can be achieved easily by engaging the lighting element 2 and the cooling fan 4 with the heat dissipater 1, 1', 1", mounting the circuit board 5 to the housing 3, 3', and engaging the housing 3 with the heat dissipater 1, 1', 1". Convenient assembly is thus provided.

With the arrangement of the first air guiding portion 111 and the second air guiding portions 121 and 34 in communication with the compartment 31 receiving the circuit board 5 and the engagement between the lighting element 2 and the heat dissipater 1, 1', 1", the cooling fan 4 drives air current to flow through the first air guiding portion 111 and the second air guiding portions 121 and 34 to provide excellent cooling effect for the lighting element 2 and the circuit board 5, enhancing the cooling effect.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. A lamp comprising:

a heat dissipater including a base and an engaging member, with the base including a first air guiding portion and a fixing portion, with the engaging member mounted to an outer periphery of the base, with a second air guiding portion formed between the engaging member and the base, with the base including a seat and an annular wall formed along an outer periphery of the seat, with the first air guiding portion formed at one side of the annular wall, and with the second air guiding portion formed at the other side of the annular wall;

a lighting element mounted to the base of the heat dissipater;

a housing engaged with the engaging member of the heat dissipater and having an opening, with the housing and the heat dissipater together defining a compartment in communication with the first and second air guiding portions, with the first air guiding portion including at least one passageway formed in a central portion of the seat, with the at least one passageway extending from a top face to a bottom face of the seat in an axial direction of the lamp, and with the second air guiding portion being in the form of a plurality of radial passageways;

a cooling fan mounted to the fixing portion of the base; and a circuit board mounted in the compartment and electrically connected to the lighting element and the cooling fan, with the circuit board electrically connected to an electrically conductive member having an end extending out from the housing, wherein the annular wall of the base extends and protrudes through the opening of the housing, with an end of the annular wall extending in an axial direction of the housing beyond the opening of the housing.

2. The lamp as claimed in claim 1, with the engaging member including a flange, with a plurality of support blocks extending from an outer surface of the flange, with the second air guiding portion including the plurality of radial passageways formed between the plurality of support blocks.

3. The lamp as claimed in claim 2, with an arcuate guide face formed between an adjoining area between the flange of the engaging member and the annular wall of the base.

4. The lamp as claimed in claim 1, with the cooling fan including a fan housing, with the fan housing including a block portion formed on an outer periphery of the fan housing, with the block portion engaged with the base.

5. The lamp as claimed in claim 1, with the housing including a first end and a second end, with the first end having the opening, with the second end having a through-hole, with the opening having an end edge fixed to the engaging member, with the end of the electrically conductive member extending out of the housing via the through-hole.

6. A lamp comprising:

a heat dissipater including a base and an engaging member, with the base including a first air guiding portion and a fixing portion, with the engaging member mounted to an outer periphery of the base, with the base including a seat and an annular wall formed along an outer periphery of the seat, with the first air guiding portion formed at one side of the annular wall, and with a second air guiding portion formed at the other side of the annular wall;

a lighting element mounted to the base of the heat dissipater;

a housing engaged with the engaging member of the heat dissipater and having an opening, with the second air guiding portion being formed on the housing, with the housing and the heat dissipater together defining a compartment in communication with the first and second air guiding portions, with the first air guiding portion including at least one passageway formed in a central portion of the seat, with the at least one passageway extending from a top face to a bottom face of the seat in an axial direction of the lamp, with the second air guiding portion including a plurality of passageways extending front an inner face to an outer face of the housing in a radial direction of the lamp, and with the plurality of passageways located adjacent to the opening of the housing;

a cooling fan mounted to the fixing portion of the base; and a circuit board mounted in the compartment and electrically connected to the lighting element and the cooling fan, with the circuit board electrically connected to an electrically conductive member having an end extending out from the housing, wherein the annular wall of the base extends and protrudes through the opening of the housing, with an end of the annular wall extending in an axial direction of the housing beyond the opening of the housing.

7. The lamp as claimed in claim 6, with the cooling fan including a fan housing, with the fan housing including a block portion formed on an outer periphery of the fan housing, with the block portion engaged with the base.

8. The lamp as claimed in claim 6, with the housing including a first end and a second end, with the first end having the opening, with the second end having a through-hole, with the opening having an end edge fixed to the engaging member, with the end of the electrically conductive member extending out of the housing via the through-hole.

* * * * *